US005588586A

United States Patent [19]

Negelen

[11] Patent Number: 5,588,586

[45] Date of Patent: Dec. 31, 1996

[54] INTERLOCKING ARRANGEMENT

[75] Inventor: Emanuel Negelen, Schweich, Germany

[73] Assignee: Riverwood International Ltd., Bristol, United Kingdom

[21] Appl. No.: 411,659

[22] PCT Filed: Oct. 4, 1993

[86] PCT No.: PCT/GB93/02060

§ 371 Date: May 10, 1995

§ 102(e) Date: May 10, 1995

[87] PCT Pub. No.: WO94/07759

PCT Pub. Date: Apr. 14, 1994

[30] Foreign Application Priority Data

Oct. 7, 1992 [GB] United Kingdom ..... 9221130

[51] Int. Cl.[6] ..... C65D 77/22

[52] U.S. Cl. ..... 229/198.2; 229/103.2

[58] Field of Search ..... 229/103.2, 198.2; 206/140, 427

[56] References Cited

U.S. PATENT DOCUMENTS

| | | | |
|---|---|---|---|
| 3,314,590 | 4/1967 | Tolaas | 206/140 |
| 3,374,938 | 3/1968 | Pierce, Jr. | 206/140 |
| 3,963,170 | 6/1976 | Wood | 229/198.2 |
| 4,077,095 | 3/1978 | Oliff | 229/198.2 |
| 4,093,116 | 6/1978 | Watkins et al. | 229/198.2 |
| 4,200,220 | 4/1980 | Ganz | 206/140 |
| 4,328,893 | 5/1982 | Oliff et al. | 206/140 |
| 4,355,717 | 10/1982 | Oliff | 206/427 |
| 4,600,140 | 7/1986 | Milliens | 229/198.2 |
| 4,878,612 | 11/1989 | Schuster | 206/427 |
| 5,180,100 | 1/1993 | Shimizu | 229/198.2 |

FOREIGN PATENT DOCUMENTS

| | | |
|---|---|---|
| 135353 | 3/1985 | European Pat. Off. . |
| 275200 | 7/1988 | European Pat. Off. . |
| 1817238 | 3/1977 | Germany . |
| 8802607 | 4/1988 | WIPO . |

*Primary Examiner*—Gary E. Elkins
*Attorney, Agent, or Firm*—Hopkins & Thomas

[57] ABSTRACT

There is provided an interlocking arrangement for coupling two pieces 10, 11 of paperboard. Projecting portions 17 on one piece 10 and openings on the other piece 11 engage as the pieces are urged together. Parallel sided flaps 20 hinged to said one piece 10 and tongues 24 on said other piece 11 are provided on the pieces with said tongues 24 being pushed past the flaps 20 when the pieces are moved together. The free ends of the tongues 24 are bent back slightly and the flaps 20 engage below the bent back ends.

15 Claims, 5 Drawing Sheets

INTERLOCKING ARRANGEMENT

FIELD OF THE INVENTION

This invention relates to an arrangement for interlocking two pieces of sheet material, particularly but not necessarily made from paperboard.

BACKGROUND OF THE INVENTION

One particular but not exclusive use is in the packaging sleeves used to form a multipack of bottles. Such sleeves are typically wrapped around a number of bottles and the ends of the sleeve are interlocked at the base. However, bottles are generally made with relatively large tolerances which can result in sleeves being too loose or impossible to interlock.

SUMMARY OF THE INVENTION

According to the present invention there is provided an interlocking arrangement for coupling two pieces of sheet material the arrangement has guide members which enable the two pieces to be moved towards and away from each other. The guide means comprises at least one projecting portion on one piece and one or more associated openings in a second piece for receiving the one or more projecting portions. The arrangement also includes locking members comprising one or more hinged tongues formed in one of the first or second pieces so as in use to extend towards the other piece and one or more flaps formed in the other piece and being hingedly connected to the other piece to thereby define a hole. In use, the first and second pieces are brought together so that the projecting portion engages the opening and the tongue is pushed into engagement with its associated flap which hinges to allow the tongue to pass through the hole. The tongue is pushed past the flap and the free end of the tongue opposite its hinge is bent back such that the flap snaps back to engage the tongue behind the bent back free end. The resilience of the tongue and flap causing interlocking between the two pieces.

In preferred arrangements the tongue and the opening are both provided on the second piece. Conveniently one projecting portion is provided having oppositely disposed, generally parallel side edges, the flap being at least partly located between said side edges and one opening is provided, the width of the opening being generally equal to the width of the projecting portion.

According to a preferred arrangement the edge part of the second piece forward of the opening is hingedly connected to the remainder of the second piece. Ideally the opening is an enclosed opening within the second piece and also the opening is generally arcuate with the edge part being narrowest generally centrally of the opening.

Preferably the tongue forms its hinge generally between the widest points of the opening and further, the tongue is generally central of the opening and extends beyond the general arc of the opening.

In preferred arrangements the flap is generally rectangular and the width of the hole is generally the same as the tongue. Also the hinge of the flap may be generally perpendicular to the side edges of the projecting portion. Preferably the flap has a nipple formation on its edge opposite the hinge.

With a preferred application the two pieces are constituted by the two ends of a paperboard wrap for wrapping an article or a number of articles. In use the article or articles may press on the free end of the projecting portion of the first piece and the edge part of the second piece.

Preferably the wrapper is for a plurality of bottles and has further apertures for receiving the heels and tops of the bottles. Ideally two or more of said locking arrangements are provided on each wrapper. At the side edges of the wrapper the openings in the second piece may not be enclosed.

BRIEF DESCRIPTION OF THE DRAWINGS

An embodiment of the invention will now be described in more detail. The description makes reference to the accompanying diagrammatic drawings in which.

DETAILED DESCRIPTION

Figure 1:
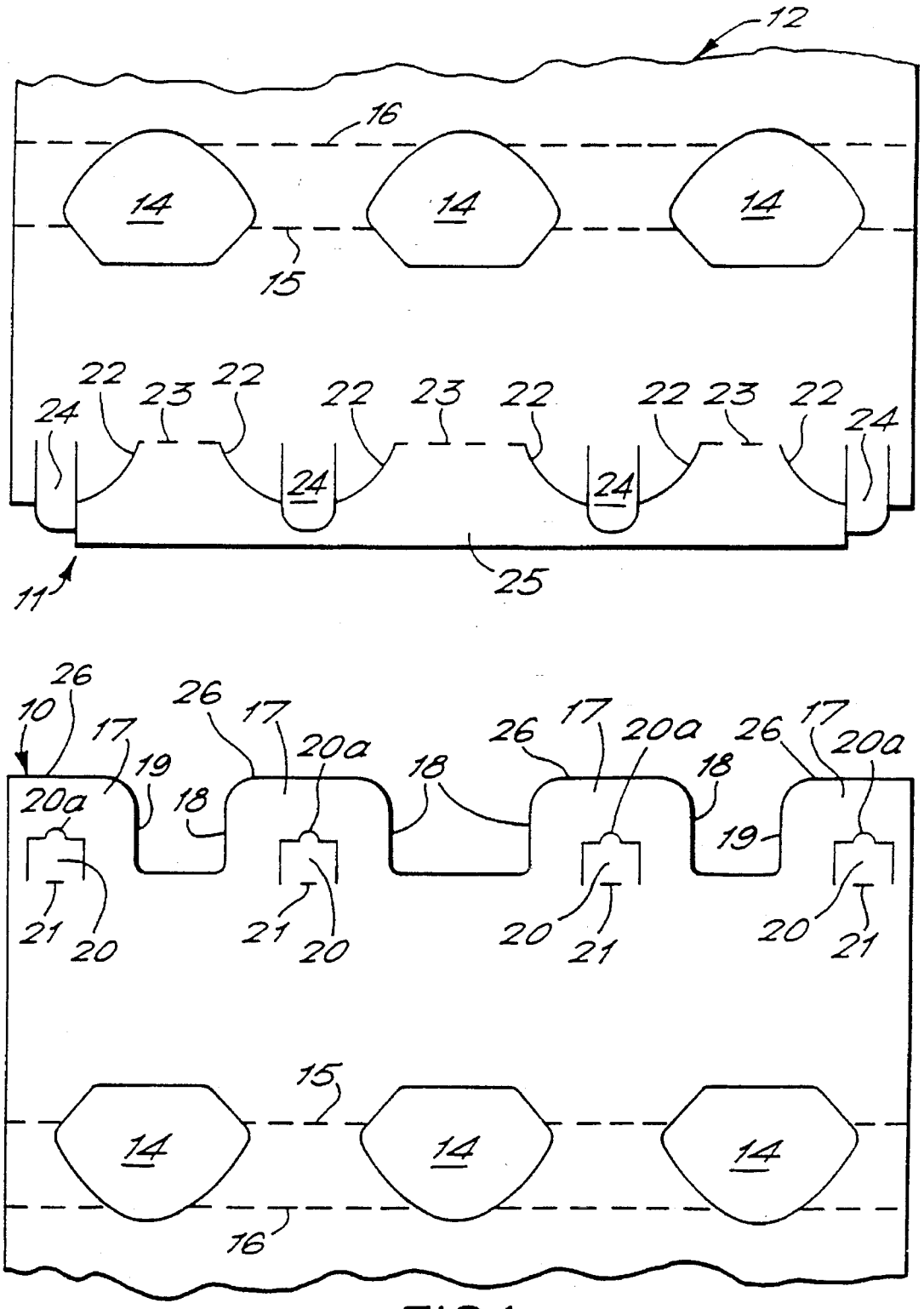
FIG. 1 shows in plan view the two ends of a paperboard sleeve according to the present invention.

FIGS. 1 to 6 show two ends 10, 11 of a blank 12 made from paperboard for forming a sleeve around a plurality, six in this case, bottles 13. The blank 12 has apertures 14 for receiving the heels of the bottles 13 and fold lines 15, 16 are provided to bend the blank 12 around the bottles 13. In addition the blank 12 will have six more apertures for receiving the crowns of the bottles. These are well known and are not, therefore, shown.

Bottles are generally made to quite large tolerances, maybe 1.5–2 mm and it is therefore preferable to use a sleeve which is capable of accommodating these tolerances so that the resulting multipack package is always tight and secure. The two ends of a sleeve blank are generally connected in the base area either by utilising interlocking formations or adhesive. The present arrangement is one of the former systems.

The end 10 is formed with projecting portions 17. The central two projecting portions 17 have generally parallel side edges 18 which are also parallel to inside side edges 19 of the end two projecting portions 17. Towards the free ends, the side edges 18, 19 are curved into a front edge 26. Each projecting portion 17 also has a flap 20 located between its side edges. The flaps 20 have straight sides and are hingedly connected to the end 10 along line 21. This hinge line 21 may be a simple fold, score or cut. The flaps 20 are, therefore, able to pivot out of the general plane of the end 10. The flaps have a nipple formation 20*a* opposite the hinge line 21.

The end 11 is formed with arcuate cuts 22 which are linked by hinge lines 23 which again may be folds or scores. The width of the projecting portions 17 is generally equal to the distance between the ends of the arcuate cuts 22. A series of four tongues 24 is also provided. The two central tongues 24 bisect a pair of the arcuate cuts 22 and extend slightly beyond an imaginary joining of respective pairs of cuts 22. A front edge portion 25 of end 11 can be hinged up slightly as is clearly shown in FIG. 2 about hinge lines 23.

Figure 2:
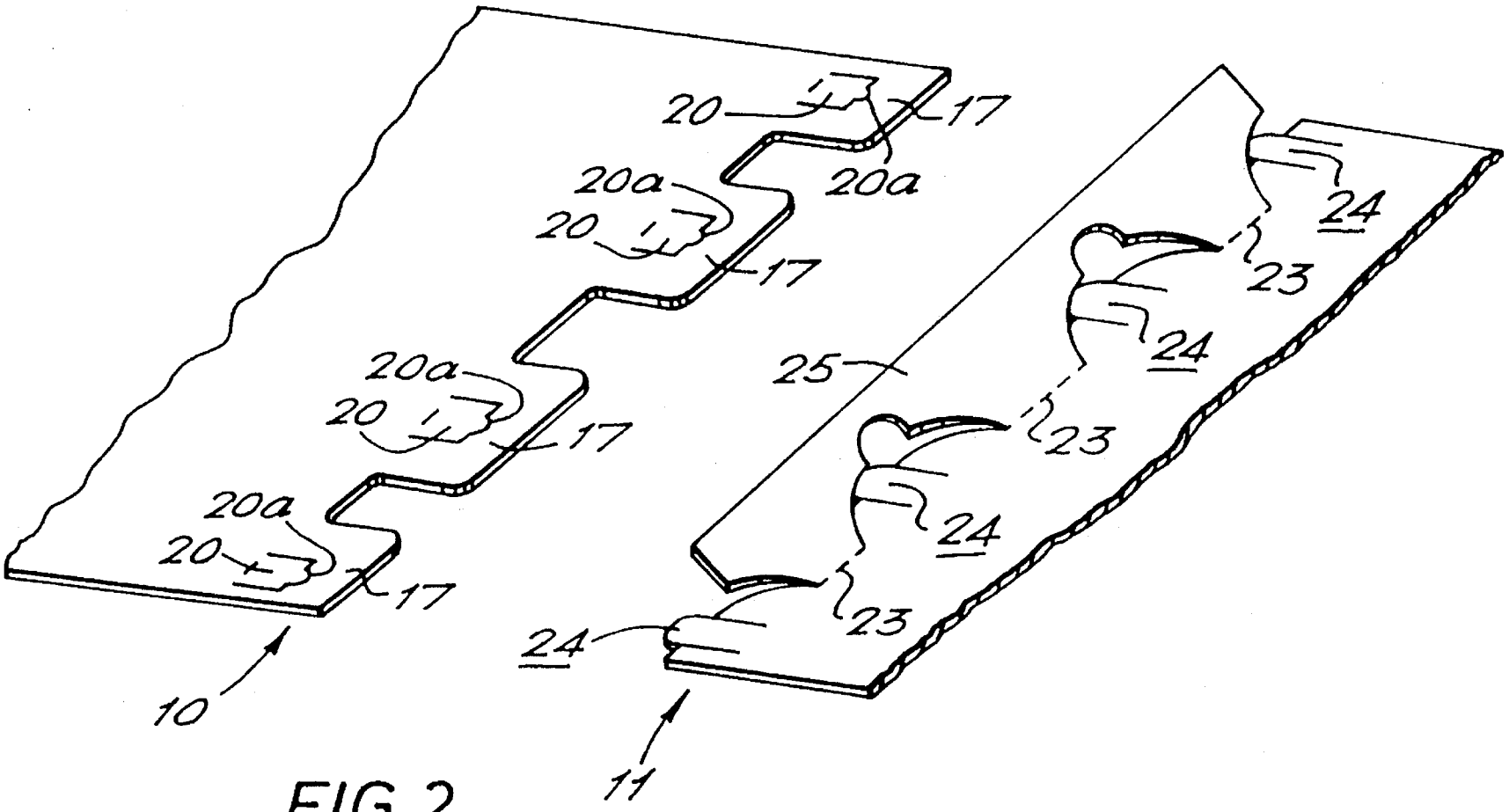
FIG. 2 is a perspective view of part of the FIG. 1 arrangement being assembled.
Figure 3:
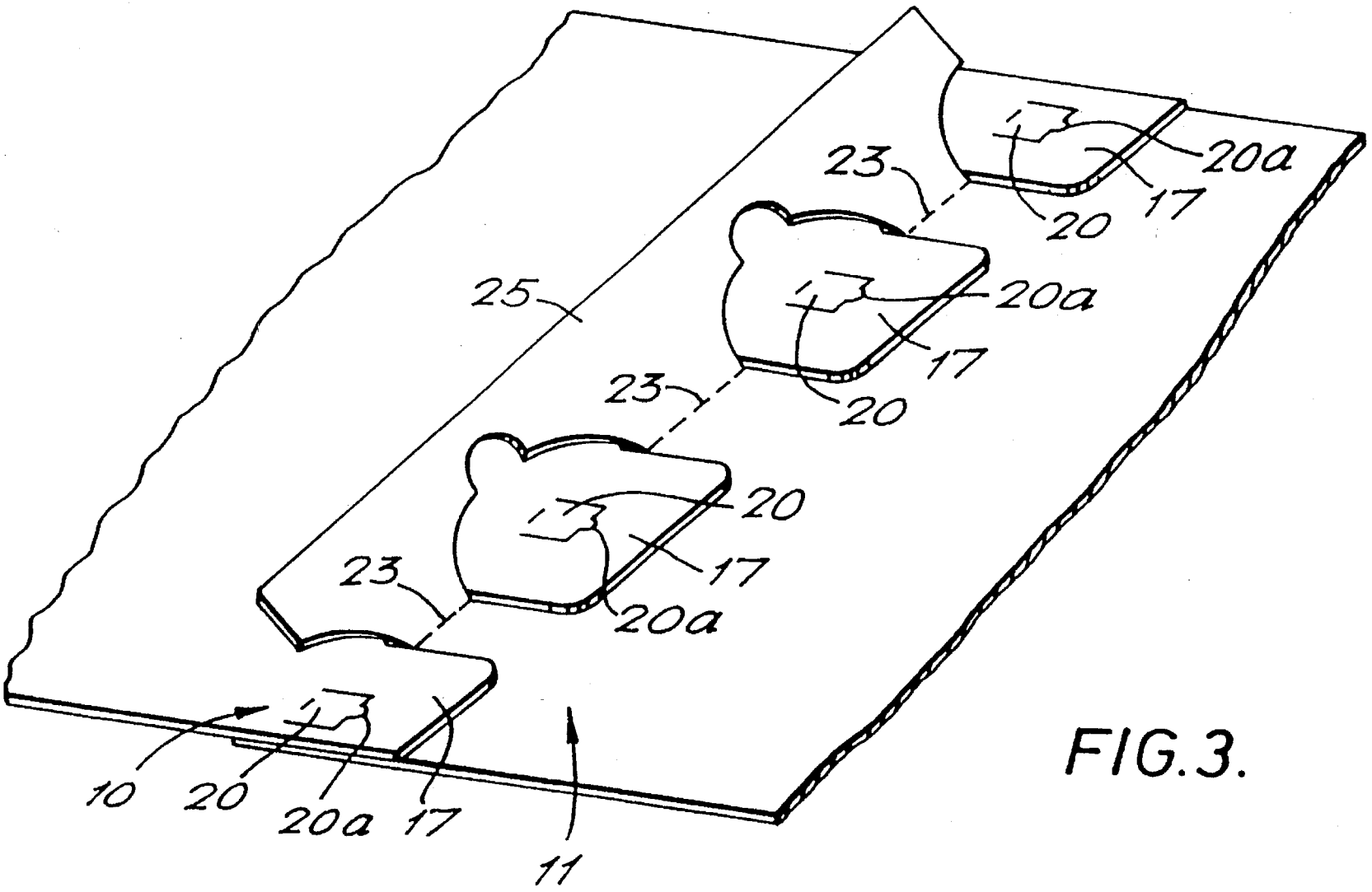
FIG. 3 is a perspective view of the FIG. 2 arrangement in a later stage of assembly.
Figure 4:
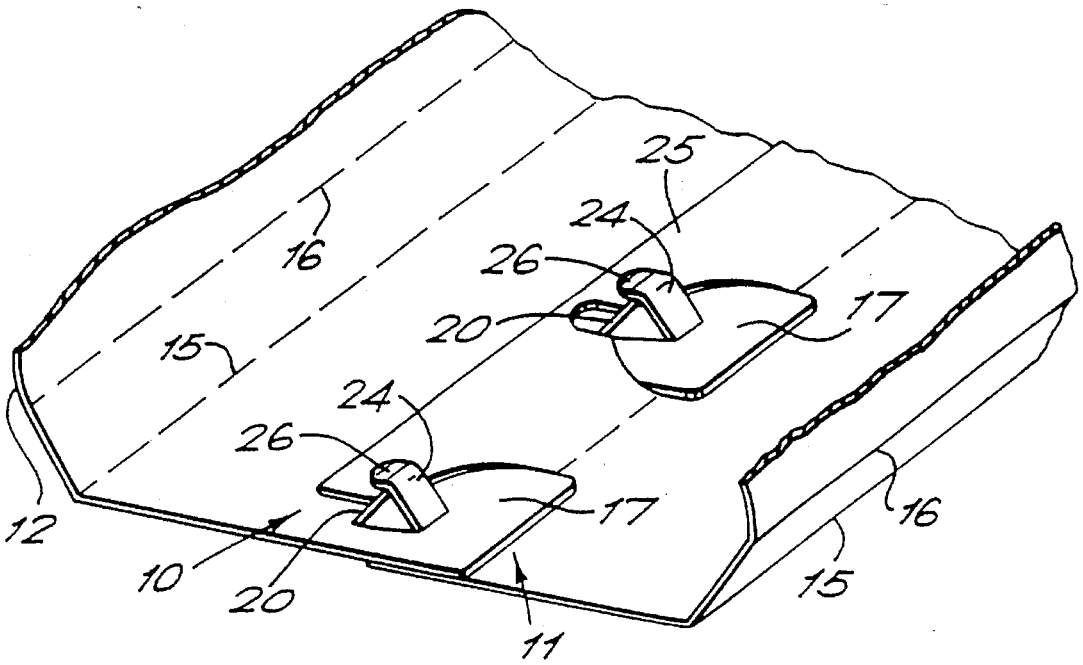
FIG. 4 is a perspective view of part of the FIG. 3 arrangement in a later stage of assembly.
Figure 5:
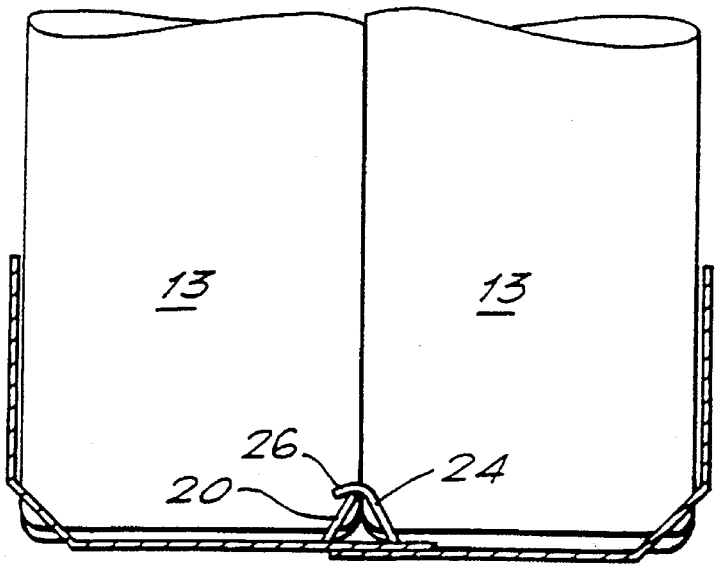
FIG. 5 is a sectional view through a finished package showing two bottles in side view.
Figure 6:
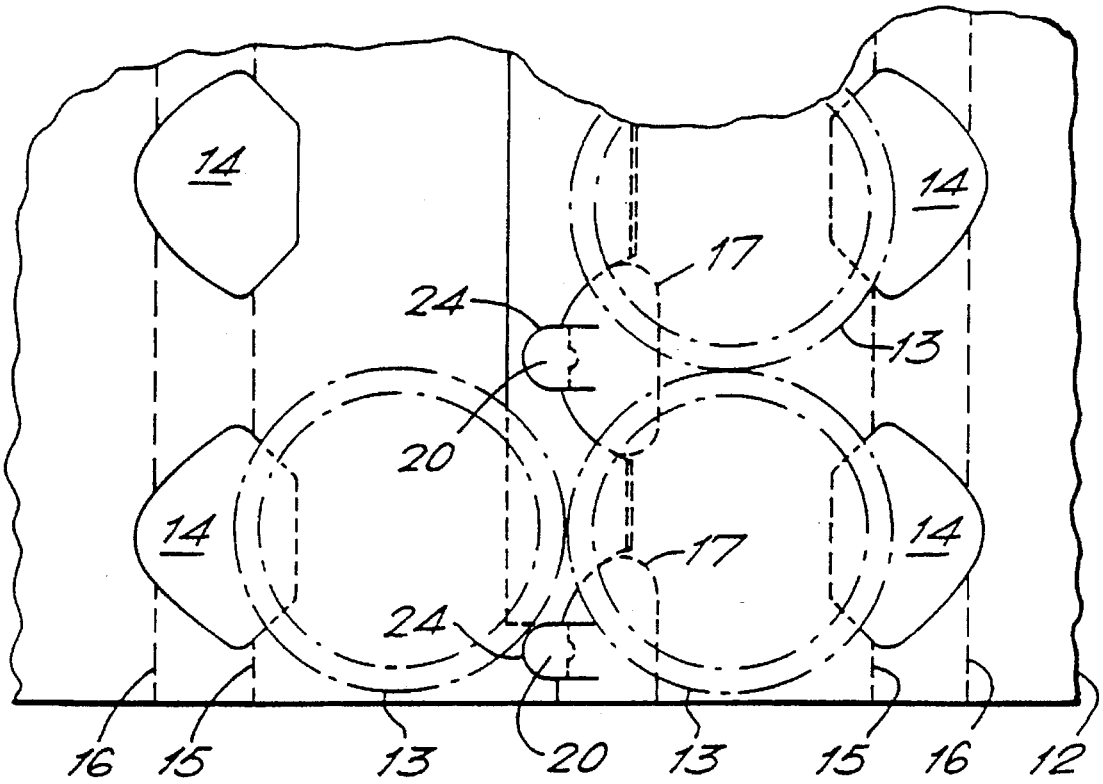
FIG. 6 is a plan view of the base of the sleeve showing the bottle positions in chain-dotted lines.

To make the two ends 10, 11 interlock, the front edge portion 25 of end 11 is bent up slightly as shown in FIG. 2. The two ends 10, 11 are then brought together so that the projecting portions 17 enter the openings formed in the end 11. The two end projecting portions 17 also engage openings in the end 11, but it will be apparent that these openings in end 11 are not enclosed like the central two openings. The result of this stage is clearly shown in FIG. 3.

The tongues 24 are now disposed generally below the flaps 20. Movement between the two ends 10, 11 is also possible and the straight side edges 18, 19 and the width of the openings ensure that the movement is in a single fixed direction, that is towards and away from each other. The movement enables the sleeve to accommodate the bottle tolerances and there is a range of movement of about 8 mm in this embodiment. When the blank 12 is being wrapped around the bottles 13 it is therefore possible for the blank 12 to be positioned such that the blank 12 tightly grips the bottles 13.

When tightly engaged, the tongues 24 are pushed up from below. The tongues 24 then cause the flaps 20 to pivot and the ends of the tongues 24 may be bent back by the position of the hinge lines 21. The tongues 24 will eventually push past the flaps 20 and the end of each tongue will remain bent back slightly as shown by numeral 26 in FIGS. 4 and 5. The resilience of the flaps 20 will cause the flaps 20 to snap back into engagement with the underside of the respective tongues 24. This results in firm interlocking of the ends 10, 11. The nipple formations 20*a* may also be bent back somewhat by this contact. This interlocking provides a larger contact area between the flaps 20 and the tongues 24, thus improving rigidity.

The bottles 13 themselves also act to make the structure rigid because they sit on the ends of the projecting portions 17 and on the front edge portion 25 of end 11. This is more clearly shown in FIG. 6.

It will be appreciated that the curved corners at the front edges 26 of the projecting portions 17 assist in the smooth entry into the openings created by the arcuate slits 22. The arcuate nature of the slits 22 also smoothes the entry.

When using the above interlocking system to fasten a sleeve it is best if there are at least two sets of interlocking tongues 24/flaps 20. More sets provide more rigidity.

It will also be appreciated that the location of the interlocking members 20 and 24 and the guide members 17 and 22 could be separated. In other words the projecting portions 17 and guide slits 22 could be located independently of the tongue 24 and flap 20 formations. For example they could be provided alternately along the edges of the ends 10, 11. Also it is not necessary for the tongues 24 to be on the same end 11 as the slits 22.

The blank 12 could also be used with other materials such as plastics and to wrap other articles such as cans. Also the bottle number and location shown is purely exemplary.

I claim:

1. An interlocking device for coupling two pieces of sheet material, comprising:

guide means for enabling the two pieces to be moved towards and away from each other, the guide means including a projecting portion on a first piece of said two pieces and means for defining an associated opening in a second piece of said two pieces, said opening for receiving said one projecting portion; and means for locking said two pieces together comprising at least one hinged tongue having a free end and formed in one of said first piece or said second piece and, in use, extending towards the other of said first piece or said second piece, said locking means further comprising at least one flap formed in said other piece and being hingedly connected to said other piece thereby defining a hole in said other piece;

said projecting portion, said opening, said tongue, and said flap are positioned relative to each other such that said projecting portion is inserted into said opening and the tongue is pushed into engagement with the flap, said flap pivoting to allow the tongue to pass through the hole;

wherein said flap has a resilience such that the flap firmly engages a bottom surface of the tongue as the tongue is being pushed into the hole, said tongue and said flap causing said first and second pieces to become interlocked to each other; and wherein the opening is enclosed within the second piece and is generally arcuate with an edge portion of the second pieced being narrowest approximately at a center of the opening.

2. An interlocking device for coupling two pieces of sheet material, comprising:

guide means for enabling the two pieces to be moved towards and away from each other, the guide means including a projecting portion on a first piece of said two pieces and means for defining an associated opening in a second piece of said two pieces, said opening for receiving said one projecting portion; and means for locking said two pieces together comprising at least one hinged tongue having a free end and hinge end formed in one of said first piece or said second piece and, in use, extending towards the other of said first piece or said second piece, said locking means further comprising at least one flap formed in said other piece and being hingedly connected to said other piece thereby defining a hole in said other piece;

so said projecting portion, said opening, said tongue, and said flap are position relative to each other such that said projecting portion is inserted into said opening and the tongue is pushed into engagement with the flap, said flap pivoting to allow the tongue to pass through the hole;

wherein said flap has a resilience such that the flap firmly engages a bottom surface of the tongue as the tongue is being pushed into the hole, said tongue and said flap causing said first and second pieces to become interlocked to each other.

3. An interlocking device as claimed in claim 2, wherein the tongue and the opening are both formed on said second piece.

4. An interlocking device as claimed in claim 2, wherein said projecting portion includes oppositely disposed, generally parallel side edges and the flap is at least partly located between said side edges, a width of the opening being approximately equal to a width of the projecting portion.

5. An interlocking device as claimed in claim 2, wherein an edge portion of the second piece is hingedly connected to the second piece.

6. An interlocking device as claimed in claim 2, wherein the opening is arcuate and the hinge end of the tongue is formed approximately at a widest part of the opening, the tongue being located approximately at a center of the opening and extending beyond the opening.

7. An interlocking device as claimed in claim 2, wherein the flap is generally rectangular and a width of the hole is approximately equal to a width of the tongue.

8. An interlocking device as claimed in claim 2, wherein a hinge line of the flap is generally perpendicular to side edges of the projecting portion.

9. An interlocking device as claimed in claim 2, wherein the flap has a nipple formation on an end opposite a hinge line of said flap.

10. An interlocking device as claimed in claim 2, wherein the two pieces comprise two ends of a paperboard wrap for wrapping at least one article.

11. An interlocking device as claimed in claim 10, wherein said projecting portion is positioned such that said at least one article engages a free end of the projecting portion on the first piece and an edge portion of the second piece.

12. An interlocking device as claimed in claim 2, wherein said first and second pieces each has at least one aperture for receiving a bottom of at least one article.

13. An interlocking device as set forth in claim 2, wherein said opening and said projecting portion are sized so as to permit said first and second pieces to move substantially only towards and away from each when said projecting portion is at least partially inserted into said opening.

14. An interlocking device as set forth in claim 2, further comprising at least a second projecting portion and a second opening, said second projecting portion being inserted into said second opening.

15. An interlocking device as set forth in claim 2, further comprising at least a second flap for defining a second hole and a second tongue for being inserted into said second hole, said second flap having said resilience so that said second flap engages a bottom surface of said second tongue.

* * * * *